US010085490B2

(12) United States Patent
Griffin et al.

(10) Patent No.: US 10,085,490 B2
(45) Date of Patent: Oct. 2, 2018

(54) SHIRTS CONFIGURED FOR ENHANCING WORKER MOBILITY

(71) Applicant: VF Imagewear, Inc., Nashville, TN (US)

(72) Inventors: David Griffin, Nashville, TN (US); Dianne Tatara, Nashville, TN (US); Amber Roberts, Nashville, TN (US); Shannon North, Murfreesboro, TN (US)

(73) Assignee: VF IMAGEWEAR, INC., Nashville, TN (US)

( * ) Notice: Subject to any disclaimer, the term of this patent is extended or adjusted under 35 U.S.C. 154(b) by 126 days.

(21) Appl. No.: 14/645,508

(22) Filed: Mar. 12, 2015

(65) Prior Publication Data

US 2016/0029702 A1 Feb. 4, 2016

Related U.S. Application Data

(60) Provisional application No. 62/031,005, filed on Jul. 30, 2014.

(51) Int. Cl.
*A41D 13/02* (2006.01)
*A41B 1/08* (2006.01)

(52) U.S. Cl.
CPC ..... *A41B 1/08* (2013.01); *A41D 13/02* (2013.01); *A41B 2400/44* (2013.01); *A41B 2400/70* (2013.01)

(58) Field of Classification Search
CPC .... A41B 1/08; A41B 2400/70; A41B 2400/44
(Continued)

(56) References Cited

U.S. PATENT DOCUMENTS 3,086,214 A 4/1963 Lash
3,137,860 A * 6/1964 Bindler ..... A41D 27/10 2/115

(Continued)

FOREIGN PATENT DOCUMENTS

CN 103140146 A 6/2013
JP 2012007252 1/2012

OTHER PUBLICATIONS

Nike Dri-Fit Knit Long-Sleeve Women's Running Shirt—Nike Store website as of Mar. 3, 2014 according to the Wayback Machine at http://web.archive.org/web/20140303034559/http://store.nike.com/us/en_us/pd/dri-fit-knit-long-sleeve-running-shirt/pid-829168/pgid-829158.

(Continued)

*Primary Examiner* — Katherine Moran
(74) *Attorney, Agent, or Firm* — McAndrews, Held & Malloy, Ltd.

(57) ABSTRACT

The present invention provides shirts, such as shirts that are worn as work uniform shirts, which are configured to provide significant improvements in a wearer's comfort, performance, and mobility over a predefined range of motions. Embodiments of the shirts comprise one or more stretch panels that are configured to provide for stretching of the shirt at an identified micro site in order to provide a wearer with enhanced mobility. In other embodiments, the manner in which the various portions of the shirt are shaped and connected together, and specifically the connection between the sleeve and the rear panel of the shirt, may be adjusted in order to provide a wearer with enhanced mobility.

12 Claims, 9 Drawing Sheets

(58) Field of Classification Search
USPC ..... 2/116
See application file for complete search history.

(56) References Cited

U.S. PATENT DOCUMENTS

| | | | | |
|---|---|---|---|---|
| 4,890,337 | A | 1/1990 | Greenberg | |
| 4,937,883 | A | 7/1990 | Shirai | |
| 5,033,123 | A | 7/1991 | Audet | |
| 5,052,053 | A | 10/1991 | Peart et al. | |
| 5,072,454 | A | 12/1991 | Trahan | |
| 5,431,030 | A | 7/1995 | Ishizaki et al. | |
| 5,477,595 | A | 12/1995 | Weingarten et al. | |
| 5,737,773 | A | 4/1998 | Dicker et al. | |
| 5,888,118 | A | 3/1999 | Kishi | |
| 5,901,374 | A | 5/1999 | Foster | |
| 6,076,187 | A | 6/2000 | Wallerstein | |
| 6,186,970 | B1 | 2/2001 | Fujii et al. | |
| 6,212,686 | B1 | 4/2001 | Krause et al. | |
| 6,279,161 | B1 | 8/2001 | Johnston | |
| 6,311,333 | B1 | 11/2001 | Batra | |
| 6,446,264 | B2 | 9/2002 | Fairhurst et al. | |
| 6,874,337 | B2 | 4/2005 | Uno et al. | |
| 7,074,204 | B2 | 7/2006 | Fujii et al. | |
| 7,146,647 | B2 | 12/2006 | Krause et al. | |
| 7,229,390 | B2 | 6/2007 | Fujii et al. | |
| 7,310,824 | B2 | 12/2007 | Walsh | |
| 7,546,853 | B2 | 6/2009 | Rock et al. | |
| 7,721,356 | B2 | 5/2010 | Utaka | |
| 7,886,367 | B2 | 2/2011 | Chapuis et al. | |
| 7,913,323 | B2 | 3/2011 | Takamoto et al. | |
| 7,941,871 | B1 | 5/2011 | Jorgensen | |
| 8,347,415 | B2 | 1/2013 | Mazzarolo | |
| 8,533,864 | B1 | 9/2013 | Kostrzewski | |
| 8,656,515 | B2 | 2/2014 | Newton et al. | |
| 2005/0164577 | A1 | 7/2005 | Reid et al. | |
| 2008/0250553 | A1* | 10/2008 | Gatto | A41D 13/02 2/457 |
| 2009/0265828 | A1 | 10/2009 | Semba et al. | |
| 2010/0001056 | A1 | 1/2010 | Chandaria | |
| 2010/0010568 | A1* | 1/2010 | Brown | A61F 5/026 607/48 |
| 2010/0256717 | A1* | 10/2010 | Brown | A61F 5/026 607/115 |
| 2011/0209263 | A1 | 9/2011 | Suzuki et al. | |
| 2012/0102618 | A1 | 5/2012 | Burmeister et al. | |
| 2012/0233738 | A1 | 9/2012 | Blauer et al. | |
| 2012/0311760 | A1* | 12/2012 | Puni | A41D 13/0512 2/69 |
| 2013/0160181 | A1 | 6/2013 | Mohr et al. | |
| 2013/0167285 | A1* | 7/2013 | Decker | A41D 13/0002 2/69 |
| 2013/0212779 | A1 | 8/2013 | Dowling et al. | |
| 2013/0217288 | A1 | 8/2013 | Martin et al. | |
| 2013/0260062 | A1 | 10/2013 | Woods, II et al. | |
| 2013/0305425 | A1 | 11/2013 | Zarabi | |
| 2014/0336556 | A1* | 11/2014 | Pucik | A61F 5/02 602/19 |
| 2015/0196067 | A1* | 7/2015 | Blakely | A41D 13/0015 2/69 |

OTHER PUBLICATIONS

Patagonia Men's Capilene 3 Midweight Zip Neck—Patagonia website as of Jan. 8, 2014 according to the Wayback Machine at http://web.archive.org/web/20140108051956/http://www.patagonia.com/us/product/mens-capilene-3-baselayer-midweight-zip-neck?p=44442-0.

REI Novara Draft Bike Jersey—REI website as of Oct. 6, 203 according to the Wayback Machine at http://web.archive.org/web/20131006161827/http://www.rei.com/product/827177/novara-draft-bike-jersey-mens.

Extended European Search Report for EP15826389, dated Dec. 12, 2017. (7 pages).

International Search Report and Written Opinion, PCT/U515/42832, dated Nov. 2, 2015.

Office Action for Chinese Patent Application No. 2015800531249, dated Mar. 15, 2018, 6 pages.

* cited by examiner

SHIRTS CONFIGURED FOR ENHANCING WORKER MOBILITY

BACKGROUND

1. Technical Field

The present technology generally relates to shirts that are configured to provide a wearer with enhanced mobility across a range of movements.

2. Description of the Related Art

Shirts designed for work uniforms tend to be subject to tightness and restriction at various locations when the wearer performs various actions. Because in many jobs these actions are commonly repeated, the tightness and restriction of the work shirt is often a source of great discomfort. Yet the durability requirements and protective nature of shirts designed for work uniforms have previously hindered the design of a work shirt that provides for enhanced mobility.

SUMMARY

The present invention provides shirts, such as shirts that are worn as work uniform shirts, which are configured to provide significant improvements in a wearer's comfort, performance, and mobility over a predefined range of motions.

Some embodiments of the shirts comprise one or more stretch panels that are configured to provide for stretching of the shirt at an identified micro site in order to provide a wearer with enhanced mobility.

Embodiments of a shirt comprise a front panel, a rear panel, a first sleeve and a second sleeve, a collar, and one or more stretch panels, the one or more stretch panels being located at one or more micro-sites in order to provide a wearer with enhanced mobility when performing one or more of the following motions: (a) bending over, (b) squatting, (c) kneeling and twisting, (d) reaching forward and up, and (e) big step. In some embodiments, the shirt is also configured to withstand industrial laundering. In some embodiments, the stretch panels have a minimum of 15% stretch, and alternatively a minimum of 20% stretch.

Some embodiments of a shirt comprising a front panel, a rear panel, a first sleeve and a second sleeve, a collar, and one or more stretch panels, the one or more stretch panels being located at one or more micro-sites in order to provide a wearer with enhanced mobility when performing one or more defined motions include a stretch panel that is located on the rear panel of the shirt and that comprises a plurality of protrusions extending from a central point. For example, the stretch panel may comprise a first protrusion extending vertically toward the collar of the shirt, a second protrusion extending diagonally downward and toward a first side of the rear panel, and a third protrusion extending diagonally downward and toward a second side of the rear panel. The angle between each of the protrusions may be between about 90 and about 150 degrees, for example between about 110 and about 130 degrees. The central point may be located substantially centrally between the first side of the rear panel and the second side of the rear panel and between about four and about twenty-five inches below the collar, for example between about seven and about fifteen inches below the collar. In some embodiments, each protrusion may converge to a tip at the end opposite the central point. And each protrusion may have a maximum width of less than ten inches, for example less than four inches. Some embodiments of a shirt comprising a front panel, a rear panel, a first sleeve and a second sleeve, a collar, and one or more stretch panels, the one or more stretch panels being located at one or more micro-sites in order to provide a wearer with enhanced mobility when performing one or more defined motions include at least a pair of stretch panels, each stretch panel spanning at least the connection between one of the first sleeve and the second sleeve and the rear panel. Each stretch panel may also extend below the sleeve and at least partially upward between the sleeve and front panel.

Some embodiments of a shirt comprising a front panel, a rear panel, a first sleeve and a second sleeve, a collar, and one or more stretch panels, the one or more stretch panels being located at one or more micro-sites in order to provide a wearer with enhanced mobility when performing one or more defined motions include at least a pair of stretch panels, each stretch panel spanning the connection between one of the first sleeve and the second sleeve and the rear panel and the connection between the sleeve and the front panel of the shirt. In some embodiments, the stretch panel may also adjoin the rear panel from at or near the bottom edge of the shirt to the shoulder of the shirt, such as to provide a seam having an "S"-like shape. In some embodiments, the stretch panel may also adjoin the front panel from at or near the bottom edge of the shirt to the shoulder of the shirt, such as to provide a seam having an "S"-like shape.

In other embodiments, the manner in which the various portions of the shirt are connected together, and specifically the connection between the sleeve and the rear panel of the shirt, may be configured in order to provide a wearer with enhanced mobility.

For example, embodiments of a shirt comprise a front panel, a rear panel, a first sleeve and a second sleeve, a collar, and an extended rear panel portion that provides a wearer with enhanced mobility when performing one or more of the following motions: (a) bending over, (b) squatting, (c) kneeling and twisting, (d) reaching forward and up, and (e) big step. Other embodiments of a shirt comprise a front panel, a rear panel, a first sleeve and a second sleeve, a collar, and an extended sleeve portion that provides a wearer with enhanced mobility when performing one or more of the following motions: (a) bending over, (b) squatting, (c) kneeling and twisting, (d) reaching forward and up, and (e) big step.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION

Figure 1A:
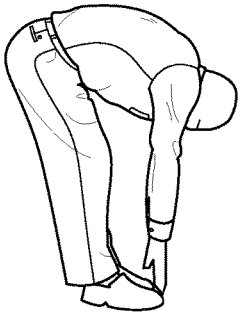
FIG. 1A is an illustration of the bending over movement, one of the five movements used to locate micro sites on embodiments of the shirts described herein.
Figure 1B:
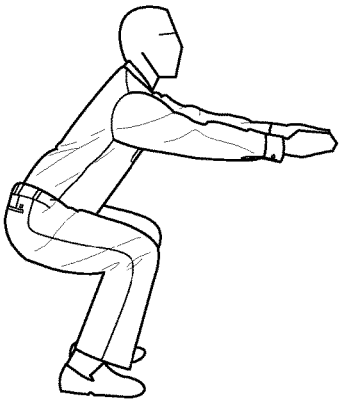
FIG. 1B is an illustration of the squatting movement, one of the five movements used to locate micro sites on embodiments of the shirts described herein.
Figure 1C:
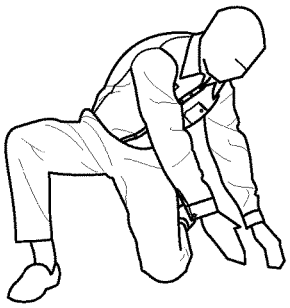
FIG. 1C is an illustration of the kneeling and twisting movement, one of the five movements used to locate micro sites on embodiments of the shirts described herein.
Figure 1D:
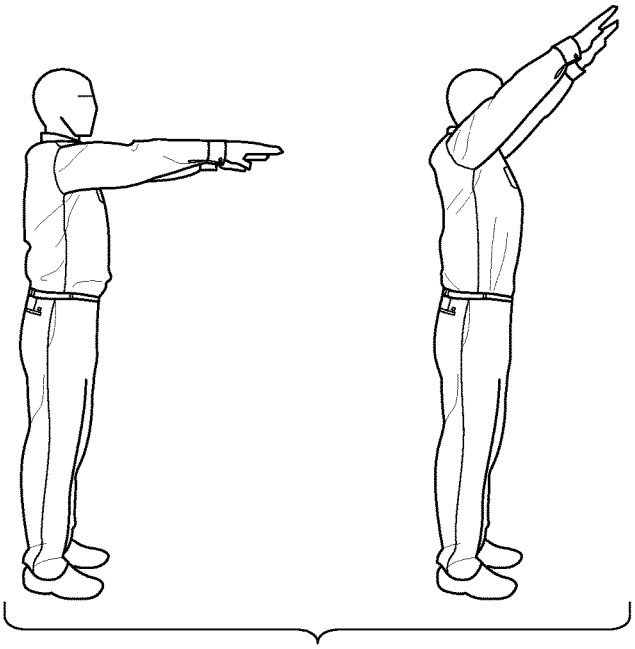
FIG. 1D is an illustration of the reaching forward and up movement, one of the five movements used to locate micro sites on embodiments of the shirts described herein.
Figure 1E:
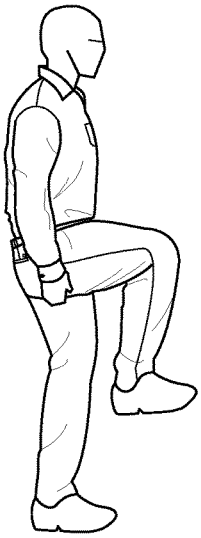
FIG. 1E is an illustration of the big step movement, one of the five movements used to locate micro sites on embodiments of the shirts described herein.

In order to provide a shirt designed for a work uniform that provides a wearer with enhanced mobility, the present inventors have developed a number of embodiments. In some embodiments, the shirt comprises a stretch panel. In other embodiments, the shapes and stitching of various elements of the shirt have been newly configured to produce enhanced mobility.

In order to determine how to configure a shirt designed for a work uniform so as to provide enhanced mobility, the present inventors used the process for designing garments responsive to the motions of a wearer that is generally described in U.S. patent application Ser. No. 14/066,501, the entirety of which is incorporated herein by reference as if fully set forth below. In brief, the process involves identifying common usage patterns and usage positions by the garment wearer, attaching markers used in motion capture photography to the bare skin of a test subject, recording position and movement data of the test subject with a computer system while the test subject repeats the common usage patterns and usage positions, processing the position and movement data to create an opportunity map which identifies stretch and compression areas of the bare skin of the test subject, attaching markers to a standard work garment worn by a test subject, recording garment construction data of the garment worn by the test subject while the test subject repeats the common usage patterns and usage positions, analyzing garment construction data to create a problem map which identifies stretch and compression areas of the garment, creating a mobility map based on the opportunity map and problem map, and using the mobility map to create a shirt design that reduces tension and restriction.

Although key body movements and positions may differ based upon the intended wearer of a shirt (for example a carpenter may have one set of associated body movements while a bricklayer has a different associated set, while a mover has a different associated set), the process was applied over a set of five distinct movements in order to prepare the embodiments of the present invention. As illustrated in FIGS. 1A-1E, the five movements are (A) bending over, (B) squatting, (C) kneeling and twisting, (D) reaching forward and up, and (E) big step. These movements were selected because they were believed to be common to a broad array of intended wearers in their respective workplaces. For example, these movements replicate those performed when picking up a box, getting into a truck, and putting an item on a shelf, among other things.

Using the mobility mapping process, a number of micro sites were identified. As defined in U.S. patent application Ser. No. 14/066,501, a "micro site" is generally an identified location on the garment for improved mobility over a predefined range of movements. Using these micro sites, a number of new shirt embodiments that provide significant improvements in a wearer's comfort, performance, and mobility were prepared.

A work shirt 1 comprises a front panel 2, a rear panel 3, a first and second sleeve 4, and a collar 5. In contrast to some athletic gear, for instance, a work shirt 1 is generally not form-fitting, i.e. it is not meant to conform to the body. In addition to work shirts, embodiments of the present invention could be incorporated into other types of shirts, such as polo shirts and tee shirts.

In embodiments of the work shirt 1, the front panel 2 runs from a bottom edge 6 up to the collar 5 (centrally located on the garment) and the shoulder seams 7 (on each side of the collar). In some embodiments, i.e. where the shirt 1 may be donned by pulling the shirt on over one's head, the front panel 2 may comprise a single portion that runs horizontally between a first side 8 and a second side 9. In preferred embodiments, and more common to the standard work shirt, the front panel 2 comprises a right portion and a left portion, which may be removably fastened to one another such as by buttons, snaps, a zipper, or the like. For purposes of this disclosure the front panel 2 will be described as having a first side 8 and a second side 9. This should not be understood as referring to a front panel 2 made up of a single portion, as described above. Rather, the front panel 2 described herein may comprise a right portion and left portion, with the first side 8 of the front panel being located on one of the right and left portions and the second side 9 of the front panel being located on the other of the right and left portions.

In a standard work shirt, the rear panel 3 comprises an upper portion, generally known as a yoke. Embodiments of the shirts 1 described herein may have a rear panel 3 that comprises a yoke. However, it was found that the yoke portion of the rear panel 3 restricts certain movements.

Accordingly, embodiments of the shirts 1 described herein may desirably have the yoke portion of the rear panel 3 removed. In these embodiments, the rear panel 3 consists of a single portion that runs from a bottom edge 10 up to the collar 5 (centrally located on the garment) and the shoulder seams 7 (on each side of the collar). Unless otherwise indication, the rear panel 3 should be understood as comprising both the embodiment including a yoke and the embodiment in which the yoke is absent. The rear panel 3 also runs horizontally between a first side 11 and a second side 12.

In embodiments of the work shirt 1, the front panel 2 and the rear panel 3 are typically adjoined, such as by sewing, at each of the right and left shoulders 7. Additionally, the first side 8 of the front panel is adjoined, such as by sewing, to the first side 11 of the rear panel and the second side 9 of the front panel is adjoined to the second side 12 of the rear panel. This is, for example, how the front and rear panels of a standard work shirt are adjoined. In other embodiments of the shirts 1 described herein, at least a portion of the first side 8 of the front panel is connected to a portion of the first side 11 of the rear panel through a stretch panel and at least a portion of the second side 9 of the front panel is connected to a portion of the second side 12 of the rear panel through a stretch panel.

Similarly, in a standard work shirt, each of the first and second sleeve portions 4 are adjoined, such as by sewing, to each of the front panel 2 and the rear panel 3. In some embodiments of the shirts 1 described herein, each sleeve 4 may be adjoined to the front panel 2 and the rear panel 3 in the standard manner. In other embodiments of the shirts 1 described herein, at least a portion of each sleeve 4 is connected to a portion of the rear panel 3 through a stretch panel 30, 40 and/or at least a portion of the sleeve 4 is connected to a portion of the front panel 2 through a stretch panel 30, 40. In yet other embodiments, the configuration of the seam 60 between the sleeve 4 and the rear panel 3 has been reconfigured so as to provide for enhanced mobility.

Embodiments of the shirt 1 may be configured to be capable of withstanding laundering under conditions that are harsher than those used in home laundering processes. For example, in some embodiments, it may be important that the fabric or fabrics that make up the shirt 1 are able to withstand industrial laundering. Many workers in a variety of fields obtain their work wear through a uniform rental program. The garments that are provided by uniform rental programs are washed by a process known as industrial laundering. Industrial laundering must meet a set of standards defined by ISO (the International Organization for Standardization) standards such as ISO 15797 and ISO 30023. For example, in contrast to home laundering processes, which typically take place at about 120° F., industrial laundering takes place at a temperature of at least 150-160° F. Industrial laundering also requires the use of stronger chemicals than those used in a home laundering process. Chemicals used in industrial laundering typically include strong alkali components and strong surfactants. Acids may also be used to bring the pH of a garment to a level that will not irritate the skin. Many industrial laundering processes also employ additional steps that include treatment with agents such as bleaches and/or antichlor compounds. As a result, fabrics that are not configured to withstand the more extreme conditions of industrial laundering may often be destroyed by the process. It is contemplated that embodiments of the shirts 1 may be provided to workers through a uniform rental program. Accordingly, embodiments of the shirts may be configured to be capable of withstanding industrial laundering.

Embodiments of the shirts 1 of the present invention comprise one or more stretch panels 20, 30, 40 that are configured to act at a micro site to provide significant improvements in a wearer's comfort, performance, and mobility.

The one or more stretch panels 20, 30, 40 of embodiments of the present invention comprise a material having an increased degree of stretchability over the material used in the remainder of the shirt 1. The stretchability of a material may be defined by a fabric stretch percentage, which is calculated using the stretch and recovery method, standardized as ASTM D2594. The stretch panels 20 preferably have a fabric stretch percentage of at least about 2%, alternatively at least about 5%, alternatively at least about 10%, alternatively at least about 15%, and alternatively at least about 20%. In some embodiments, for example, the stretch panels may have a fabric stretch percentage between about 20% and about 30%. The stretchability may also be defined according to the direction in which stretching forces are applied. 2-way stretch fabrics stretch in one direction (e.g. either lengthwise or crosswise), while 4-way stretch fabrics stretch in both directions (lengthwise and crosswise). Embodiments of the stretch panel 20, 30, 40 described herein may comprise 2-way stretch, 4-way stretch, and combinations thereof. In some embodiments, the stretch panel 20 comprises a 4-way stretch material, such as a 4-way stretch material having a fabric stretch percentage in both directions of at least about 2%, alternatively at least about 5%, alternatively at least about 10%, alternatively at least about 15%, and alternatively at least about 20%. In some embodiments, for example, the stretch panels may have a fabric stretch percentage that is between about 20% and about 30% in both directions.

For example, in some embodiments, the stretchable fabric may comprise a blend of polyester, cotton, and spandex. The blend of polyester, cotton, and spandex may, for example, be specially configured to withstand industrial laundering. In view of the above disclosure, it is believed that a person of ordinary skill in the art would understand, and be able to select from, a variety of stretchable fabrics that could be used in the stretch panels 20, 30, 40 of embodiments presented herein.

The one or more stretch panels 20, 30, 40 can be adjoined to the base material of the shirt by conventional methods that would be understood by a person of skill in the art. For example, the stretch panel 20, 30, 40 can be adjoined to the base material of the shirt by sewing. Any conventional stitching methods may be used, including but not limited to over stitch, under stitch, chain stitch, lock stitch, flat stitch, and the like.

In some embodiments, the one or more stretch panels 20, 30, 40 may be substantially concealed when not being subjected to a movement that causes it to stretch. For example, the shirt 1 may also comprise one or more flaps that cover the stretch panel 20 so that the stretch panel is substantially concealed when not being subjected to a movement that causes it to stretch. The flaps are desirably made of the base material of the shirt 1 and may provide an additional protective element to the wearer in the area of the stretch panel 20.

In some embodiments, the one or more stretch panels 20, 30, 40 may also be configured to provide the shirt with enhanced thermal management properties. For example, in some embodiments, the one or more stretch panels 20, 30, 40 may have a moisture-wicking property that is greater than the base material of the shirt. And in some embodiments, the one or more stretch panels 20, 30, 40 may have an air permeability that is greater than the base material of the shirt. When used in connection with clothing, air permeability it is often described as "breathability." The air permeability of a fabric is also closely related to its drying time. Accordingly, in some embodiments where the one or more stretch panels 20, 30, 40 are configured to provide both enhanced moisture-wicking properties and enhanced air permeability, the enhanced air permeability of the one or more stretch panels may assist in the drying of the moisture that is wicked to the outer face of the fabric, enhancing the moisture-wicking function of the fabric.

Additionally, although the invention is described herein as being directed to a stand-alone shirt, it should be understood that the shirt described herein may also be a segment of a full body uniform, such as a coverall. While some of the general components of a coverall top segment may take on a slightly different form from a stand-alone work shirt, the mobility enhancing features of any of the stand-alone shirts described herein could be equally applicable to the top segment of a coverall, as would be understood by a person of ordinary skill in the art. Accordingly, the term shirt, as used herein, is not limited to stand-alone shirts, but rather should be understood to include the shirt-portion of a coverall, for example.

Figure 2B:
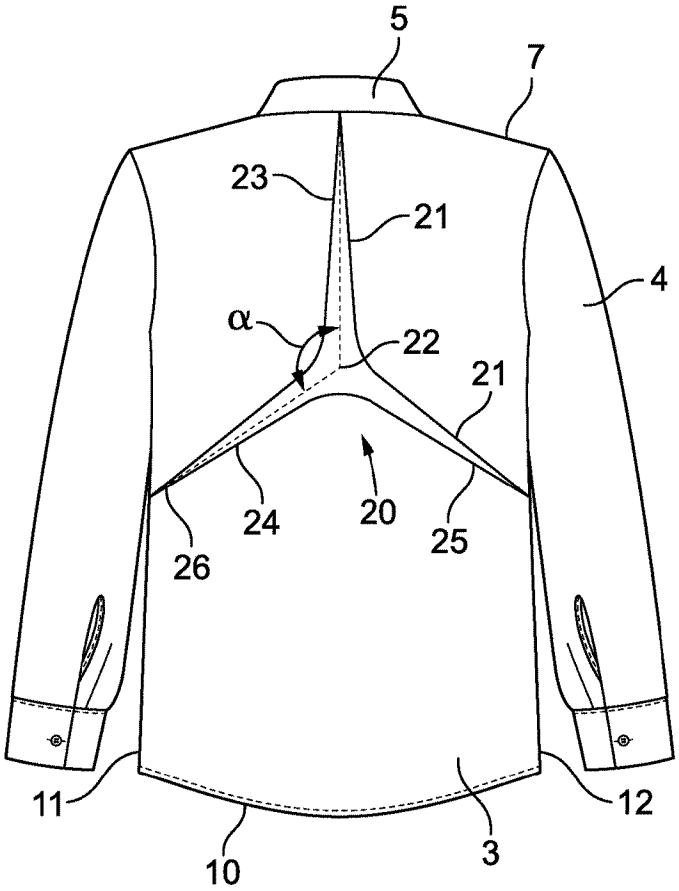
FIG. 2B is a rear view of an embodiment of a shirt configured to provide a wearer with increased mobility.
Figure 2A:
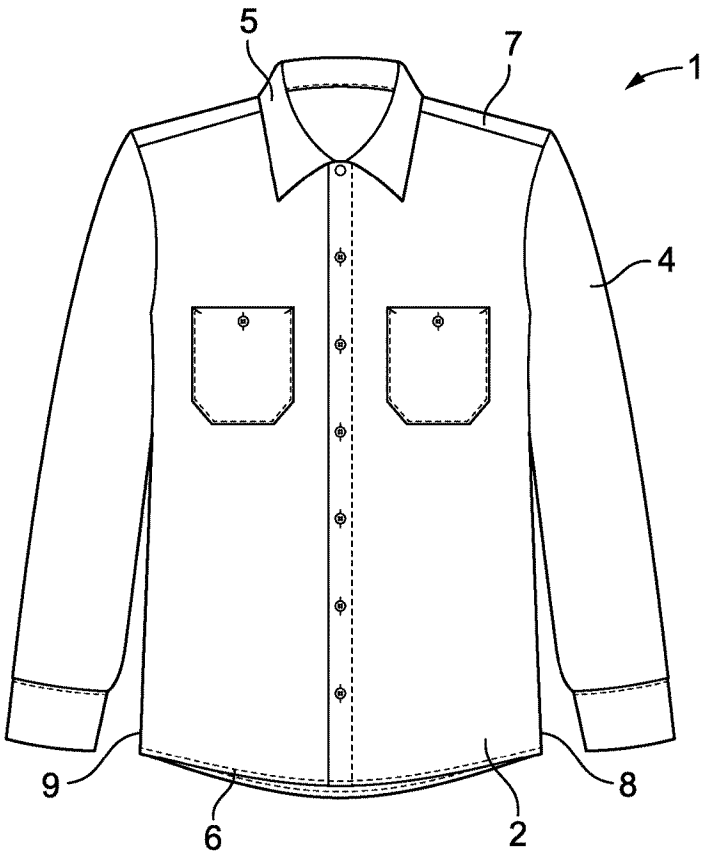
FIG. 2A is a front view of an embodiment of a shirt configured to provide a wearer with increased mobility.
Figure 3A:
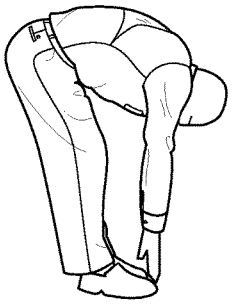
FIG. 3A is an illustration of the embodiment shown in FIG. 2 providing a wearer with increased mobility when subjected to a bending over movement.
Figure 3B:
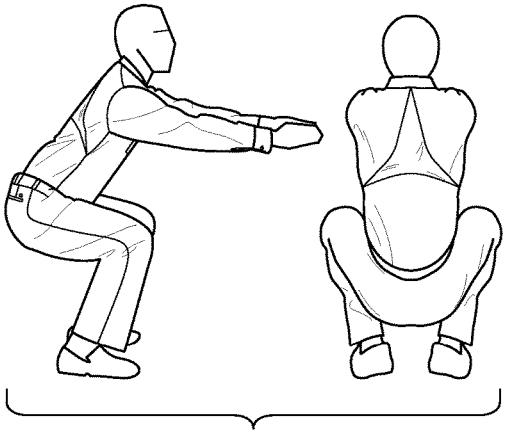
FIG. 3B is an illustration of the embodiment shown in FIG. 2 providing a wearer with increased mobility when subjected to a squatting movement.
Figure 3C:
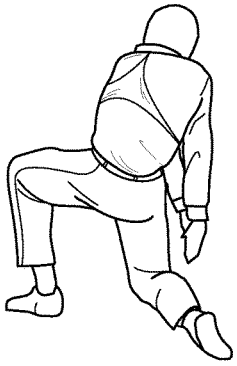
FIG. 3C is an illustration of the embodiment shown in FIG. 2 providing a wearer with increased mobility when subjected to a kneeling and twisting movement.
Figure 3D:
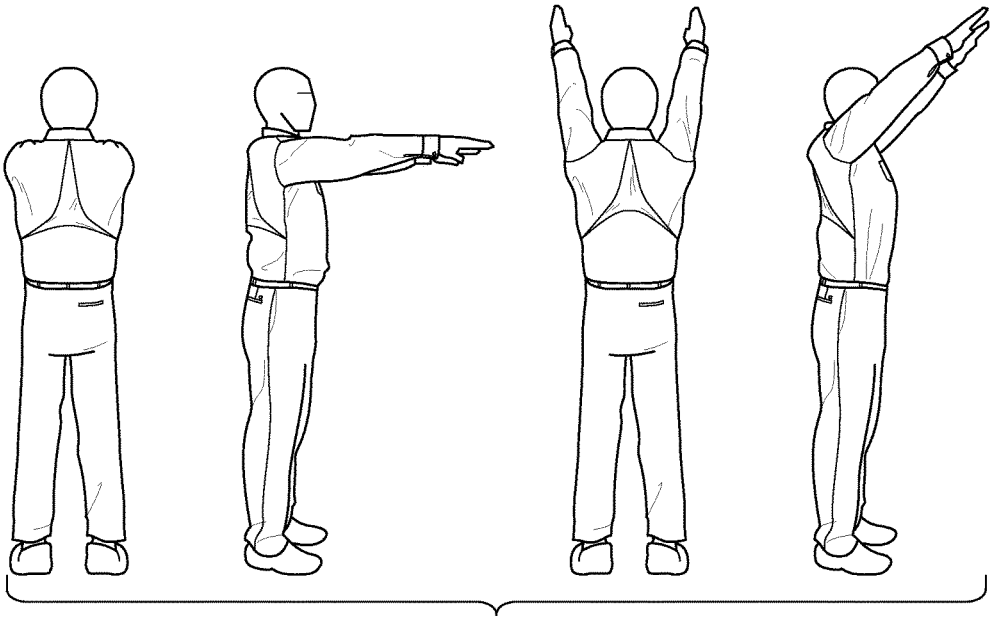
FIG. 3D is an illustration of the embodiment shown in FIG. 2 providing a wearer with increased mobility when subjected to a reaching forward and up movement.

An embodiment of the present invention is illustrated in FIGS. 2A and 2B. The embodiment illustrated in FIGS. 2A and 2B comprises a stretch panel 20 located on the rear panel 3 of the shirt 1. The stretch panel 20 comprises a plurality of protrusions 21 that extend from a central point 22. In some embodiments, the angle $\alpha$ between each of the plurality of protrusions 21 (i.e. the angle formed by two adjacent protrusions about the central point 22) is between about 90 degrees and about 150 degrees, alternatively between about 95 degrees and about 145 degrees, alternatively between about 100 degrees and about 140 degrees, alternatively between about 110 degrees and about 130 degrees, alternatively between about 115 degrees and about 126 degrees, alternatively between about 118 and about 123 degrees.

In some embodiments, the stretch panel 20 comprises a first protrusion 23 extending vertically toward the collar 5 of the shirt, a second protrusion 24 extending diagonally downward and toward a first side 11 of the rear panel 3, and a third protrusion 25 extending diagonally downward and toward a second side 12 of the rear panel.

The angle formed by the first protrusion 23 and the second protrusion 24 is preferably between about 90 degrees and about 150 degrees, more preferably between about 95 degrees and about 145 degrees, more preferably between about 100 degrees and about 140 degrees, more preferably between about 110 degrees and about 130 degrees, more preferably between about 115 degrees and about 126 degrees. In some embodiments, the angle formed by the first protrusion 23 and the second protrusion 24 is between about 118 and about 123 degrees.

The angle formed by the first protrusion 23 and the third protrusion 25 is preferably between about 90 degrees and about 150 degrees, more preferably between about 95 degrees and about 145 degrees, more preferably between about 100 degrees and about 140 degrees, more preferably between about 110 degrees and about 130 degrees, more preferably between about 115 degrees and about 126 degrees. In some embodiments, the angle formed by the first protrusion 23 and the third protrusion 25 is between about 118 and about 123 degrees.

The angle formed by the second protrusion 24 and the third protrusion 25 is preferably between about 90 degrees and about 150 degrees, more preferably between about 95 degrees and about 145 degrees, more preferably between about 100 degrees and about 140 degrees, more preferably between about 110 degrees and about 130 degrees, more preferably between about 115 degrees and about 126 degrees. In some embodiments, the angle formed by the second protrusion 24 and the third protrusion 25 is between about 118 and about 123 degrees.

In some embodiments, the central point 22 of the stretch panel 20 is located substantially central to the rear panel 3 of shirt between the first side 11 and the second side 12. By substantially central it is meant within 3 inches from the center point between the first side 11 and the second side 12 of the rear panel 3. Preferably, the central point 22 of the stretch panel 20 is located within 2 inches from the center point between the first side 11 and the second side 12 of the rear panel 3. Preferably, the central point 22 of the stretch panel 20 is located within 1 inch from the center point between the first side 11 and the second side 12 of the rear panel 3.

In some embodiments, the central point 22 of the stretch panel 20 is located between about four and about twenty-five inches below the seam that adjoins the rear panel 3 to the collar 5, more preferably between about five and about eighteen inches below the seam that adjoins the rear panel to the collar, more preferably between about six and about fifteen inches below the seam that adjoins the rear panel to the collar, more preferably between about seven and about fourteen, alternatively between about eight and about thirteen inches below the seam that adjoins the rear panel to the collar.

In some embodiments, each of the plurality of protrusions 21 converges, or narrows in width, so as to form a tip 26 at the end of the protrusion opposite the central point 22. The width of each protrusion 21 may be selected, depending on the size and intended usage of the shirt 1, to provide the desired amount of stretchability to the shirt while at the same time minimizing the dimensions of the stretch panel 20 (and accordingly the amount of stretch material used in the garment). In some embodiments, each protrusion 21 has a maximum width, i.e. the width at the widest portion of the protrusion, of less than ten inches, alternatively less than seven inches, alternatively less than five inches, alternatively less than three inches. In some embodiments, each protrusion has a maximum width between about 0.5 inches and about five inches, alternatively between about 0.5 inches and about four inches, alternatively between about 0.5 inches and about three inches.

The length of each protrusion 21 may also be selected, depending on the size and intended usage of the shirt 1, to provide the desired amount of stretchability to the shirt while at the same time minimizing the dimensions of the stretch panel 20 (and accordingly the amount of stretch material used in the garment). In some embodiments, each protrusion 21 has a length between about 5 and about 25 inches, alternatively between about 6 and about 20 inches, alternatively between about 7 and about 16 inches, alternatively between about 8 and about 15 inches.

The stretching of an embodiment such as described above in response to the common motions applied to the mobility mapping process is shown in FIGS. 3A to 3D. The embodiment illustrated comprises a stretch panel located on the rear panel of the shirt and having a first protrusion, a second protrusion, and a third protrusion radiating from a central point, as described above. As a wearer performs the range of motions, the stretch panel provides for stretching of the rear panel of the shirt at the identified micro sites in order to provide significant improvements in a wearer's comfort, performance, and mobility.

Figure 4B:
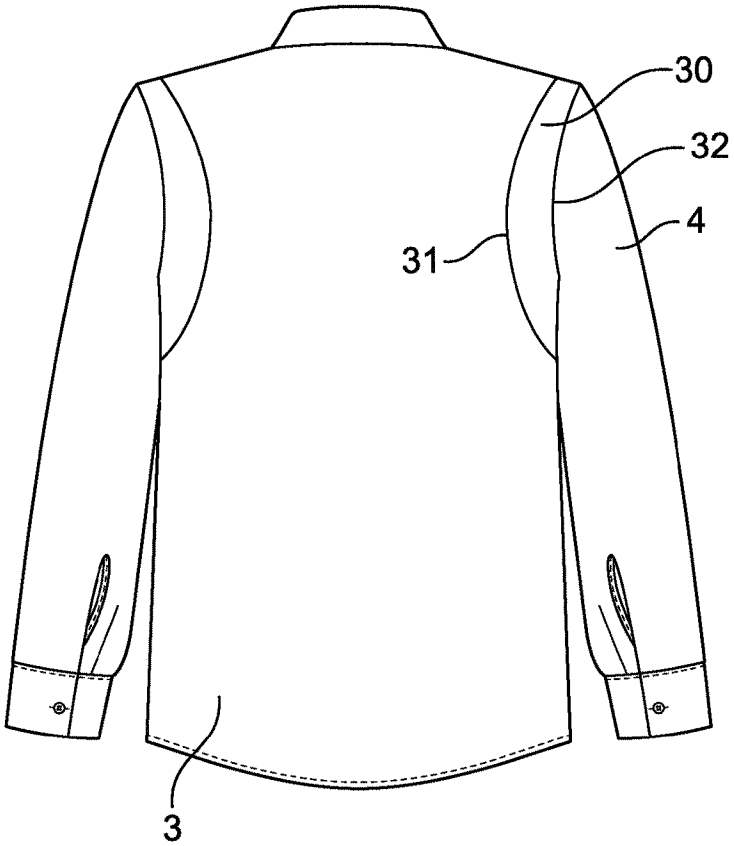
FIG. 4B is a rear view of an embodiment of a shirt configured to provide a wearer with increased mobility.
Figure 4A:
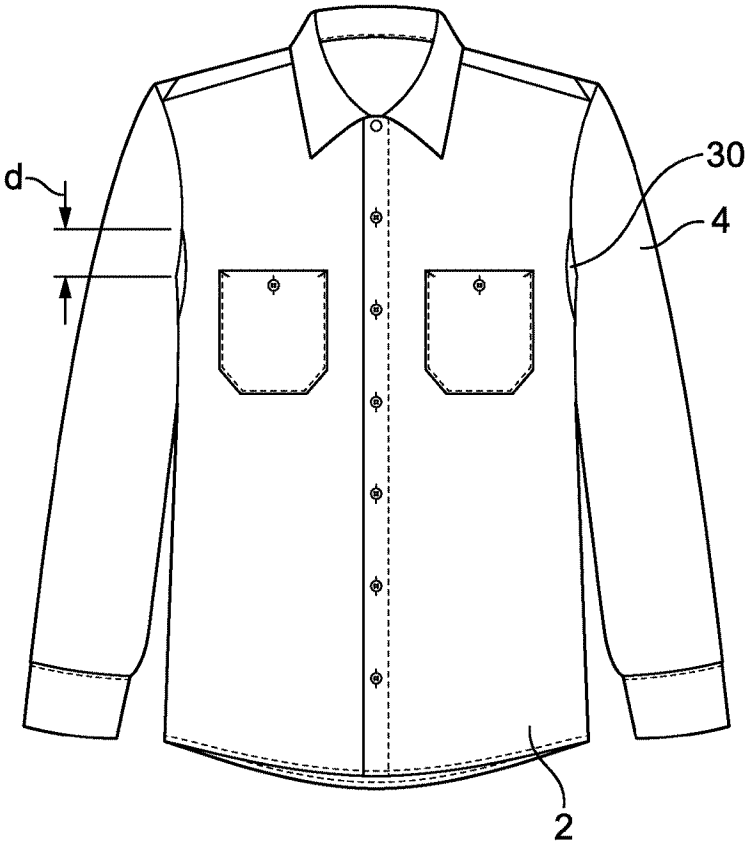
FIG. 4A is a front view of an embodiment of a shirt configured to provide a wearer with increased mobility.

Another embodiment of the present invention is illustrated in FIGS. 4A and 4B. The embodiment illustrated in FIGS. 4A and 4B comprises a first stretch panel 30 that spans the connection between the first sleeve portion 4 and the rear panel 3 and a second stretch panel that spans the connection between the second sleeve portion and the rear panel. Accordingly, each stretch panel 30 is adjoined, such as by sewing, on a first side 31 to the rear panel 3 and on a second (and opposite) side 32 to the sleeve 4. As such, the sleeve 4 is not directly adjoined to the rear panel 3 of the shirt. Rather the sleeve 4 is connected to the stretch panel 30, which is connected to the rear panel 3 of the shirt. In some embodiments, such as is illustrated in FIG. 4B, the stretch panel 30 curves around the sleeve 4, so as to have a convex first side 31 and a concave second side 32.

The maximum width between the first side 31 of each stretch panel and the second side 32 of each stretch panel may be selected, depending on the size and intended usage of the shirt 1, to provide the desired amount of stretchability to the shirt while at the same time minimizing the dimensions of the stretch panel 30 (and accordingly the amount of stretch material used in the garment). In some embodiments, each stretch panel 30 has a maximum width, i.e. the width at the widest portion between the first side 31 and the second side 32, of less than eight inches, alternatively less than seven inches, alternatively less than six inches, alternatively less than five inches, alternatively less than four inches. In some embodiments, each stretch panel has a maximum width between about 0.5 and about five inches, alternatively between about 0.5 and about four inches, alternatively between about one and about four inches.

In some embodiments, the stretch panel 30 also extends below the sleeve 4 and at least partially upward between the sleeve and the front panel 2 of the shirt. In the embodiment illustrated in FIG. 4A, for example, each stretch panel 30 partially spans the connection between the sleeve 4 and the front panel 2. In some embodiments, the stretch panel 30 spans the connection between the sleeve portion 4 and the front panel 2 for a distance d that is between about 0.5 inches and about 10 inches, alternatively between about 1 inch and about 8 inches, alternatively between about 1 inch and about 6 inches, as determined by measuring the length of the seam adjoining the second side 32 of the stretch panel to the sleeve 4, starting at the point of the seam that is vertically aligned with the line formed by the side seam of the shirt that connects the front panel 2 with the rear panel 3.

The stretching of an embodiment such as described above in response to the common motions applied to the mobility mapping process is not illustrated. However, as a wearer performs the range of motions, the stretch panel 30 provides for stretching of the shirt 1 at the identified micro sites in order to provide significant improvements in a wearer's comfort, performance, and mobility.

Figure 5B:
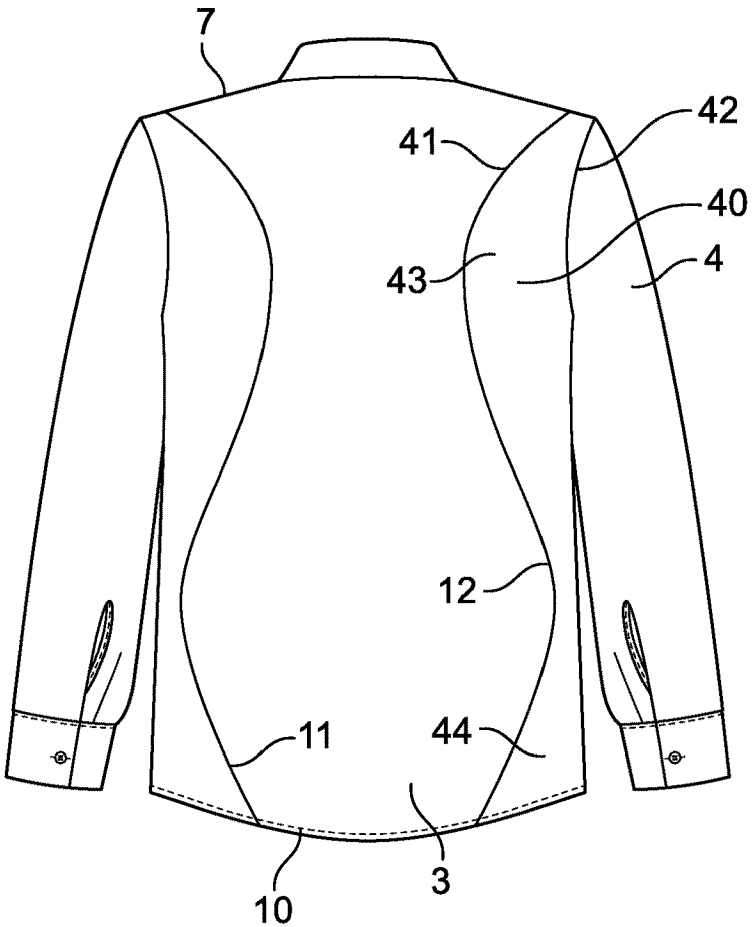
FIG. 5B is a rear view of an embodiment of a shirt configured to provide a wearer with increased mobility.
Figure 5A:
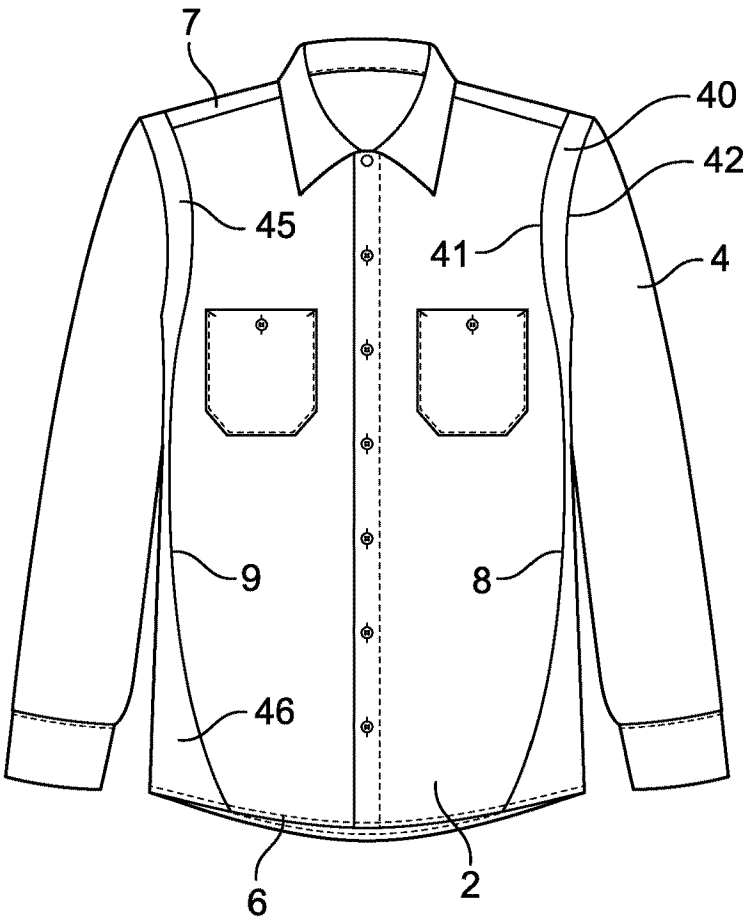
FIG. 5A is a front view of an embodiment of a shirt configured to provide a wearer with increased mobility.
Figure 6A:
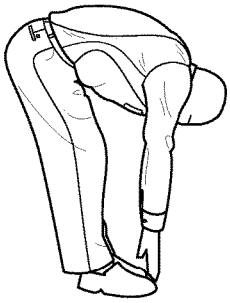
FIG. 6A is an illustration of the embodiment shown in FIG. 5 providing a wearer with increased mobility when subjected to a bending over movement.
Figure 6B:
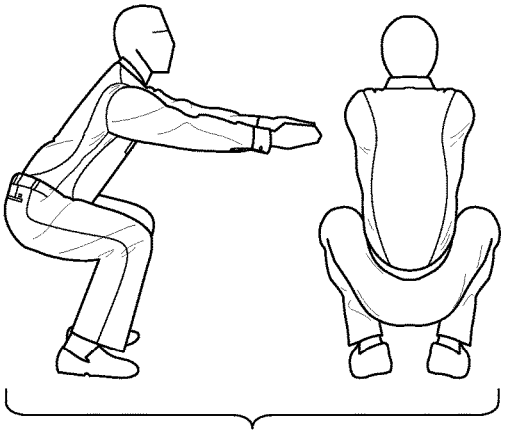
FIG. 6B is an illustration of the embodiment shown in FIG. 5 providing a wearer with increased mobility when subjected to a squatting movement.
Figure 6C:
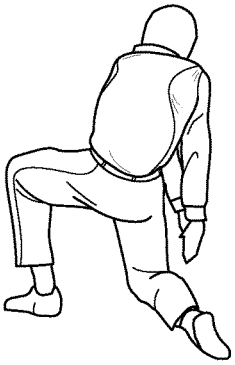
FIG. 6C is an illustration of the embodiment shown in FIG. 5 providing a wearer with increased mobility when subjected to a kneeling and twisting movement.
Figure 6D:
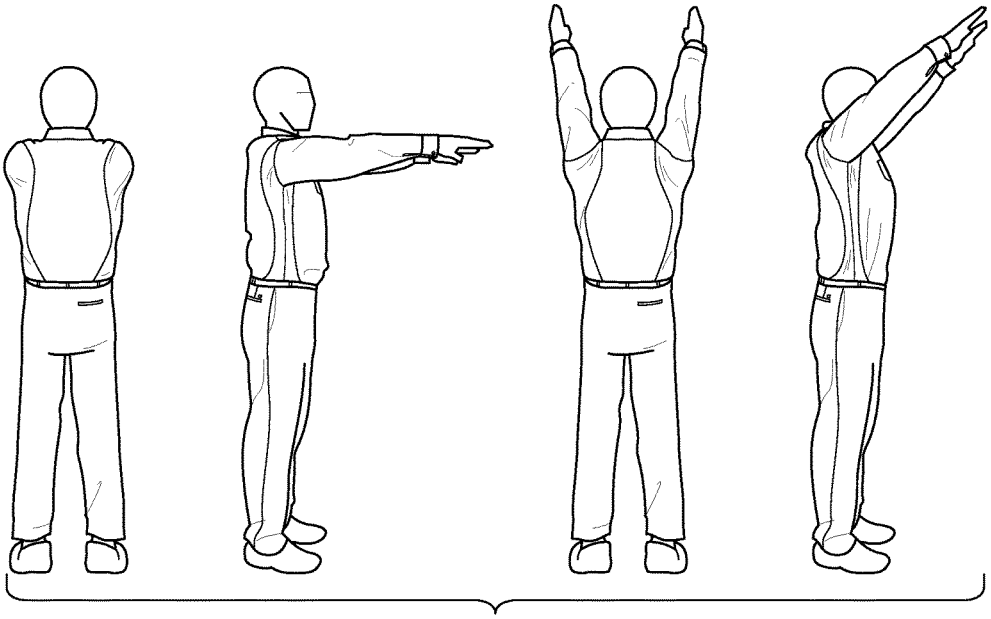
FIG. 6D is an illustration of the embodiment shown in FIG. 5 providing a wearer with increased mobility when subjected to a reaching forward and up movement.

Another embodiment of the present invention is illustrated in FIGS. 5A and 5B. The embodiment illustrated in FIGS. 5A and 5B also comprises a first stretch panel 40 that spans the connection between the first sleeve portion 4 and the rear panel 3 and a second stretch panel that spans the connection between the second sleeve portion and the rear panel. However, in contrast to the embodiment described above, each of the stretch panels 40 of the embodiment illustrated in FIGS. 5A and 5B also span the connection between the sleeve portion 4 and the front panel 2. Accordingly, each stretch panel 40 is adjoined, such as by sewing, on a first side 41 to the front panel and on a second (and opposite) side 42 to the sleeve. As such, the sleeve 4 is not directly adjoined to the front panel 2 of the shirt. Rather the sleeve 4 is connected to the stretch panel 40, which is connected to the front panel 2 of the shirt. In some embodiments, such as is illustrated in FIG. 5A, the stretch panel 40 curves around the sleeve 4, so as to have a convex first side 41 and a concave second side 42.

In some embodiments, the stretch panel 40 also adjoins the rear panel 3 from at or near the bottom edge of the rear panel 10 up to the shoulder 7. The stretch panel 40 may also adjoin the front panel 2 from at or near the bottom edge of the front panel 6 to the shoulder 7. Accordingly, in some embodiments, the first side 8 of the front panel 2 is not directly adjoined to the first side 11 of the rear panel 3 and the second side 9 of the front panel is not directly adjoined to the second side 12 of the rear panel. Rather, the first side 8 of the front panel is connected to the stretch panel 40, which is connected to the first side 11 of the rear panel and the second side 9 of the front panel is connected to the stretch panel 40, which is connected to the second side 12 of the rear panel.

In some embodiments, such as the embodiment illustrated in FIG. 5B, the seam adjoining the stretch panel 40 to the rear panel 3 from at or near the bottom edge of the rear panel 10 to the shoulder 7 forms an "S"-like shape. In other words, the seam panel curves from at or near the side of the rear panel 3 inward toward the center of the rear panel, then back outward toward the side of the rear panel, and finally back inward toward the center of the rear panel. The widest portions of the stretch panel 40 are preferably located at the portions identified by reference numbers 43 and 44. The locations of these curves along the height of the rear panel 3 may vary depending on the size of the shirt 1 and the intended usage of the shirt. The curved seam provides a wearer with additional mobility by flexing straight when stretched.

Additionally, in some embodiments, such as the embodiment illustrated in FIG. 5A, the seam adjoining the stretch panel 40 to the front panel 2 from at or near the bottom edge of the front panel 6 to the shoulder 7 forms an "S"-like shape. In other words, the seam curves from at or near the side of the front panel 2 inward toward the center of the front panel, then back outward toward the side of the front panel, and finally back inward toward the center of the front panel. The widest portions of the stretch panel 40 are preferably located at the portions identified by reference numbers 45 and 46. The locations of these curves along the height of the front panel 2 may vary depending on the size of the shirt 1 and the intended usage of the shirt. The curved seam provides a wearer with additional mobility by flexing straight when stretched.

The stretching of an embodiment such as described above in response to the common motions applied to the mobility mapping process is shown in FIGS. 6A through 6D. The embodiment illustrated comprises a stretch panel 40 that spans the connection between the sleeve portion 4 and the rear panel 3 and the connection between the sleeve portion and the front panel 2. The stretch panel 40 also adjoins both the rear panel 3 and the front panel 2 from the bottom edges of the shirt 6,10 to the shoulder 7. Both the seam adjoining the stretch panel 40 to the rear panel 3 and the seam adjoining the stretch panel 40 to the front panel 2 form an "S"-like shape. As a wearer performs the range of motions, the stretch panel 40 provides for stretching of the shirt at the identified micro sites in order to provide significant improvements in a wearer's comfort, performance, and mobility.

In some alternative embodiments, the stretch panel 40 shown in FIGS. 5 and 6 may be replaced with a conventional fabric. In these embodiments, the panel around the sleeves and along the sides of the shirt provides a wearer with enhanced mobility even without the use of a material having an increased degree of stretchability over the material used in the remainder of the shirt 1.

Figure 7:
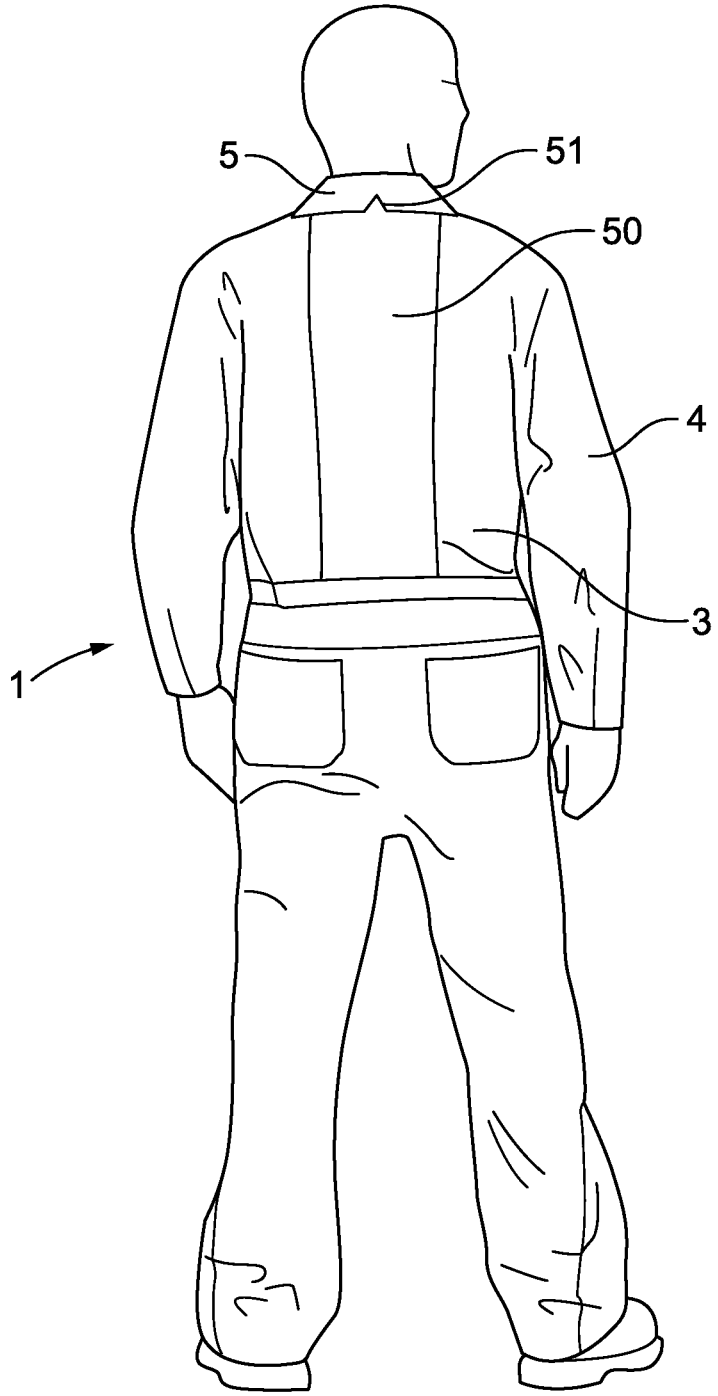
FIG. 7 is a rear view of an embodiment of a shirt segment of a coverall configured to provide a wearer with increased mobility.

Another embodiment of the present invention is illustrated in FIG. 7. The embodiment in FIG. 7 has been illustrated as the shirt component of a coverall garment. Although not so limited, this embodiment is particularly desirable for use in a shirt 1 that is a component of a coverall. For example, in addition to increasing mobility across the described range of movements, this embodiment also makes it easier for a wearer to pull a coverall over his or her shoulders when donning and/or doffing the coverall garment. The embodiment illustrated in FIG. 7 comprises a stretch panel 50 located on rear portion 3 of the shirt segment 1 of a coverall and spanning the height of the rear portion between the waist and the collar 5. The stretch panel 50 is located substantially centrally along the rear portion 3 of the shirt segment 1 of the coverall. In some embodiments, the stretch panel 50 may also extend into the collar portion 5 of the coverall. The collar 5 may also comprise a v-shaped notch 51 that creates extra room for donning and/or doffing of the coverall garment.

The width of the stretch panel 50 may be selected, depending on the size and intended usage of the coverall, to provide the desired amount of stretchability to the shirt segment 1 while at the same time minimizing the dimensions of the stretch panel (and accordingly the amount of stretch material used in the garment). In some embodiments, the stretch panel 50 has a width between about one and about twenty inches, alternatively between about five inches and about fifteen inches.

In other embodiments of the present invention, the shaping of the various portions of the shirt 1 and the manner in which the portions of the shirt are connected together, and specifically the connection between each of the sleeves 4 and the rear panel 3 of the shirt may be specially configured in order to provide enhanced mobility.

Figure 8B:
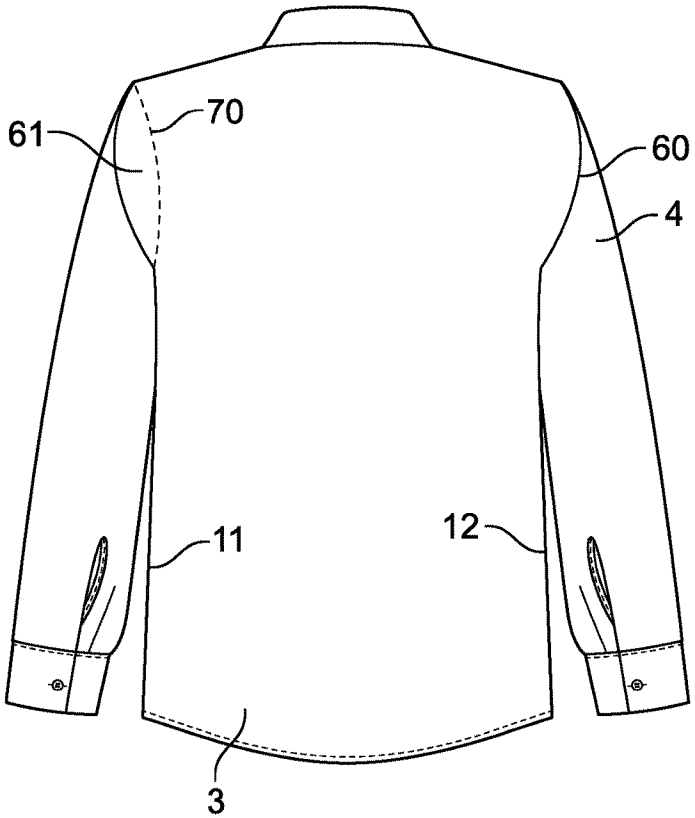
FIG. 8B is a rear view of an embodiment of a shirt configured to provide a wearer with increased mobility.
Figure 8A:
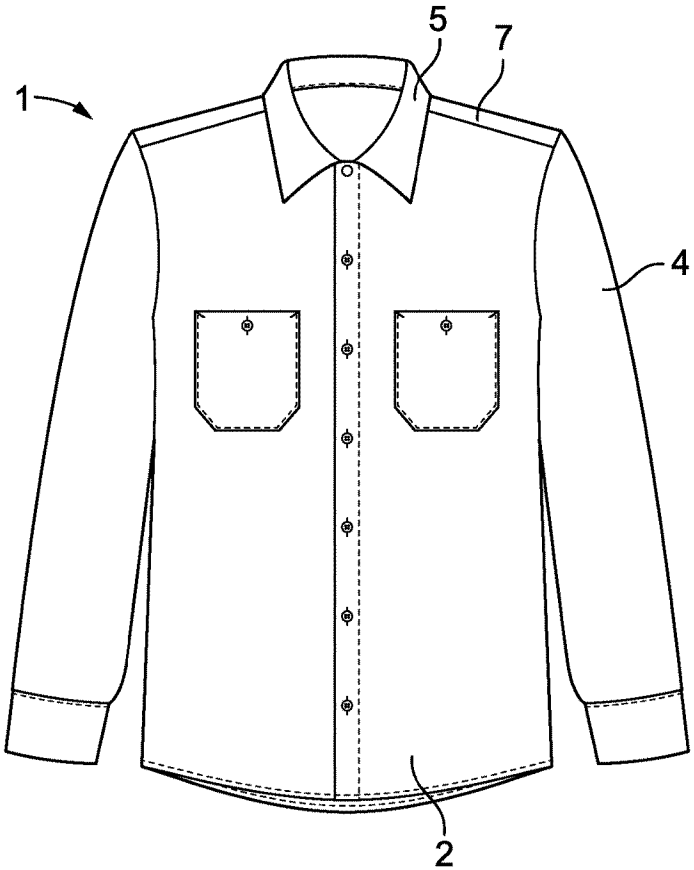
FIG. 8A is a front view of an embodiment of a shirt configured to provide a wearer with increased mobility.

For example, another embodiment of the present invention is illustrated in FIGS. 8A and 8B. The embodiment illustrated in FIGS. 8A and 8B comprises an "extended rear panel portion" identified by reference 61. In a standard shirt 1, the seam that adjoins a sleeve to a rear panel has a radius of curvature facing away from the rear panel and toward the sleeve. In other words, the seam has a convex side that extends toward the center of the rear panel. This standard seam is indicated in FIG. 8B, for example, by the dashed line identified by reference 70. In contrast, the seam 60 of this embodiment has a radius of curvature facing toward the rear panel 3 and away from the sleeve 4, such that the seam has a convex side that extends away from the center of the rear panel.

In this way, the rear panel 3 has a greater width between its first side 11 and its second side 12 in the area around the sleeve 4, which may be called an extended rear panel portion 61. As a wearer performs the range of motions, the extended rear panel portion 61 provides additional fabric at the identified micro sites in order to provide significant improvements in a wearer's comfort, performance, and mobility. When viewed from the front, however, the shirt 1 may have the appearance of a standard work shirt.

Figure 9B:
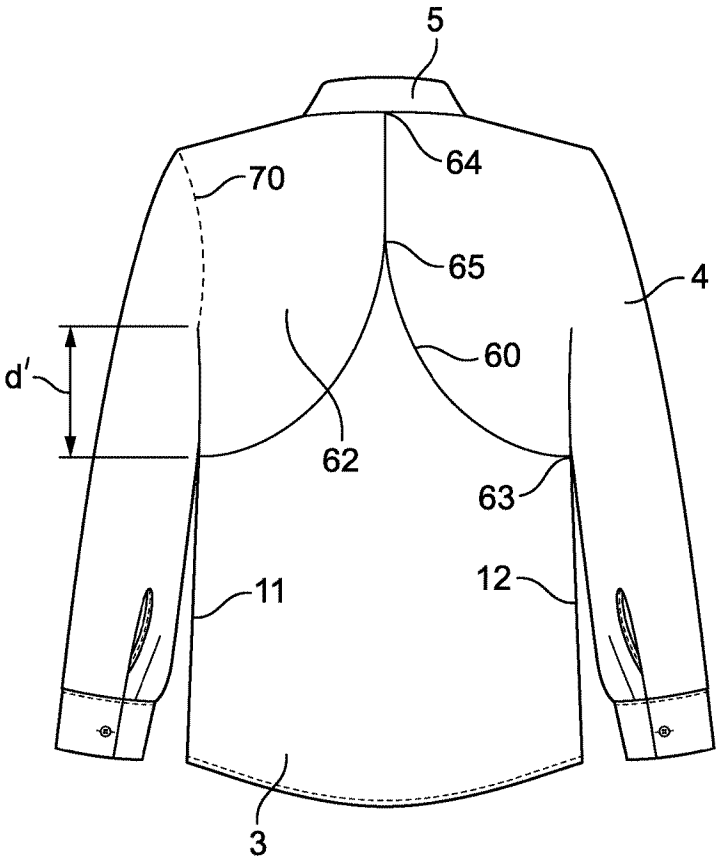
FIG. 9B is a rear view of an embodiment of a shirt configured to provide a wearer with increased mobility.
Figure 9A:
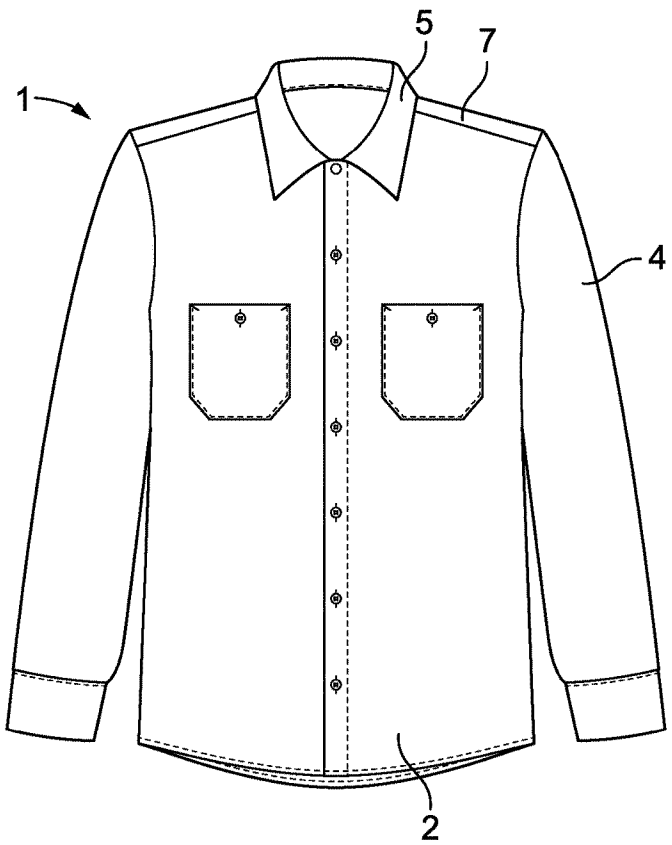
FIG. 9A is a front view of an embodiment of a shirt configured to provide a wearer with increased mobility.

Alternatively, the embodiment illustrated in FIGS. 9A and 9B comprises an "extended sleeve portion" identified by reference 62. In contrast to a standard shirt, the extended sleeve portion of the embodiment illustrated in FIGS. 9A and 9B has a seam 60 that adjoins the sleeve 4 to the rear panel 3 that traverses the rear panel of the shirt from a point 63 at the first side of the rear panel 11 up the a point 64 at the collar 5. The point 63 at the first side of the rear panel 12 may be a distance d' below the lowest point at which the sleeve 4 adjoins the front panel 2 of the shirt. This distance d' may be, for example, between about two inches and about fifteen inches, alternatively between about three inches and about twelve inches, alternatively between about four inches and about ten inches, alternatively between about six inches and about eight inches.

In some embodiments, the seam 60 connecting the sleeve 4 to the first side 11 of the rear panel 3 curves upward from the point 63 at the first side of the rear panel described above to a point 65 that is substantially central between the first side 11 of the rear panel and the second side 12 of the rear panel, at which point 65 the seam 60 extends vertically to the point 64 at the collar 5. As such, in some embodiments, the seam 60 connecting the sleeve 4 to the first side 11 of the rear panel and the seam 60 connecting the sleeve to the second side 12 of the rear panel overlap at a location 65 substantially central between the first side 11 of the rear panel and the second side 12 of the rear panel.

In this way, each of the sleeves 4 may extend well into the region of the shirt 1 that is normally considered to be the rear panel 3, to produce an extended sleeve portion 62. As a wearer performs the range of motions, the extended sleeve portion 62 provides additional fabric at the identified micro sites in order to provide significant improvements in a wearer's comfort, performance, and mobility. When viewed from the front, however, the shirt 1 may have the appearance of a standard work shirt.

It should be understood that none of the shirts 1 described and/or claimed herein are in any way limited by the process in which they were designed or produced. In other words, although the shirts 1 described and/or claimed herein were designed by the mobility mapping process described above, that process should in no way be considered a required component or element of the shirts themselves.

It can be seen that the described embodiments provide unique and novel shirts that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A shirt configured for enhanced mobility, comprising:

a. a front panel, a rear panel, a first sleeve, a second sleeve, and a collar; and b. a stretch panel located on the rear panel and comprising a plurality of protrusions that extend from a central point, the plurality of protrusions including:

a first protrusion extending vertically toward the collar of the shirt, wherein an end of the first protrusion coincides with a seam adjoining the collar to the rear panel;

a second protrusion extending diagonally downward and toward a first side of the rear panel, and a third protrusion extending diagonally downward and toward a second side of the rear panel;

wherein the stretch panel provides a wearer with enhanced mobility when performing one or more of the following motions: (a) bending over, (b) squatting, (c) kneeling and twisting, (d) reaching forward and up, and (e) big step.

2. The shirt of claim 1, in which the shirt is configured to withstand industrial laundering.

3. The shirt of claim 1, in which the stretch panel has a four-way stretch of at least 15%.

4. The shirt of claim 1, in which the stretch panel has a four-way stretch of at least 20%.

5. The shirt of claim 1, in which the angle between each of the protrusions is between about 110 and about 130 degrees.

6. The shirt of claim 1, in which the central point is located substantially centrally between the first side of the rear panel and the second side of the rear panel and between about eight and about thirteen inches below the collar.

7. The shirt of claim 1, in which each protrusion has a maximum width of less than three inches.

8. The shirt of claim 1, wherein the shirt is a segment of a coverall.

9. The shirt of claim 1, in which an end of the second protrusion coincides with a seam adjoining the front panel and the first side of the rear panel, and an end of the third protrusion coincides with a seam adjoining the front panel and the second side of the rear panel.

10. The shirt of claim 1, in which the stretch panel has an air permeability that is greater than an air permeability of a base material of the shirt.

11. The shirt of claim 1, in which the stretch panel has a moisture-wicking property that is greater than a moisture-wicking property of a base material of the shirt.

12. A shirt configured for enhanced mobility, comprising:

a. a front panel, a rear panel, a first sleeve, a second sleeve, and a collar; and b. a stretch panel located on the rear panel and comprising a plurality of protrusions that extend from a central point, the plurality of protrusions including:

a first protrusion extending vertically toward the collar of the shirt along a vertical axis located approximately midway between a first side of the rear panel and a second side of the rear panel, a second protrusion extending diagonally downward and toward the first side of the rear panel, and a third protrusion extending diagonally downward and toward the second side of the rear panel;

wherein the stretch panel provides a wearer with enhanced mobility when performing one or more of the following motions: (a) bending over, (b) squatting, (c) kneeling and twisting, (d) reaching forward and up, and (e) big step;

wherein each protrusion converges to a tip at an end opposite the central point, the tip of the first protrusion coincides with a seam adjoining the collar to the rear panel, the tip of the second protrusion coincides with a seam adjoining the front panel and the first side of the rear panel, and the tip of the third protrusion coincides with a seam adjoining the front panel and the second side of the rear panel.

* * * * *